United States Patent [19]

Wilson

[11] 4,269,269

[45] May 26, 1981

[54] LOCK TAB FOR CENTRALIZER END RING

[75] Inventor: Donald R. Wilson, Duncan, Okla.

[73] Assignee: Halliburton Company, Duncan, Okla.

[21] Appl. No.: 38,982

[22] Filed: May 14, 1979

[51] Int. Cl.[3] ..... E21B 17/10

[52] U.S. Cl. ..... 166/241

[58] Field of Search ..... 166/241; 308/4 A; 175/325

[56] References Cited

U.S. PATENT DOCUMENTS

| | | | |
|---|---|---|---|
| 2,248,160 | 7/1941 | Crawford | 166/241 |
| 2,680,488 | 6/1954 | Atkinson | 166/241 |
| 2,738,019 | 3/1956 | Atkinson | 166/241 |
| 3,055,432 | 9/1962 | Park | 166/241 |
| 3,356,147 | 12/1967 | Dreyfuss | 166/241 |
| 4,011,907 | 3/1977 | Clay | 166/241 |
| 4,088,186 | 5/1978 | Callihan et al. | 166/241 |

*Primary Examiner*—James A. Leppink

*Attorney, Agent, or Firm*—John H. Tregoning; James R. Duzan

[57] ABSTRACT

A centralizer having spring ends with inwardly projecting radial lugs for non-weld attachment to an end collar of the centralizer and deformable tab means on each lip of the end collars which are deformed into engagement with a surface of a recess in each end of each spring.

1 Claim, 5 Drawing Figures

LOCK TAB FOR CENTRALIZER END RING

Figure 1:
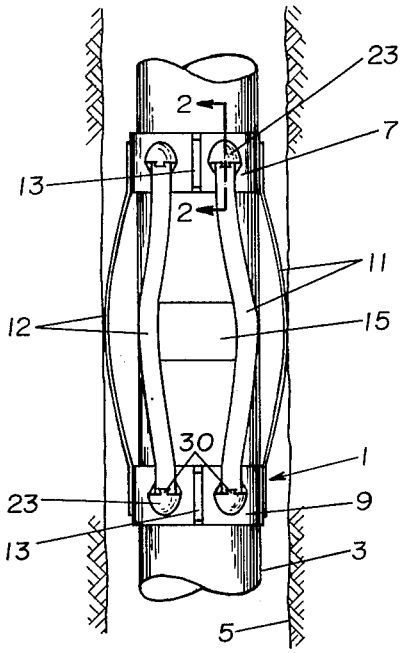

This invention relates to centralizers for use in wells, and more specifically to non-weld centralizers.

The use of a centralizer is advantageous for many purposes. The drilling for oil, gas or water and the installation of casing creates a need for casing centralizers. The productive formation or casing cannot be fully protected by cement unless the casing is uniformly cemented on all sides in the wellbore. Tubing centralizers are used on tubing strings in wells for protection against wear on the tubing and collars when the string is being pulled and rerun.

Since oil wells may be located in various places throughout the world, the cost of the transportation of the centralizers is very significant. Also, since equipment transportation space may be limited, it is desirable to make a centralizer which can be shipped within minimum space confines.

Prior art centralizer designs which occupy a large volume of space, when assembled, during shipping are exemplified in U.S. Pat. Nos. 2,546,582; 2,605,844; 2,666,241; 2,849,071; 2,998,848; 3,000,444; 3,044,554; 3,343,608; 3,379,258; 3,556,042; 3,566,965; 3,575,239; 3,578,084; 3,749,168; 3,929,388; 4,042,023; and 4,088,186; in Canadian Pat. Nos. 614,366; 614,420; 726,498; 790,394 and 935,760; and U. K. Pat. Nos. 682,489 and 682,490.

In contrast to these centralizer designs, other prior art centralizers which may be shipped unassembled occupying a small volume of space and later assembled using releasable fastening means are exemplified in U.S. Pat. Nos. 2,680,488; 2,727,576; 2,738,019; 3,055,432; 3,356,147; 4,011,907; 4,042,022 and 4,077,470; in U. K. Pat. Nos. 662,551; 683,036; 1,014,736; 1,110,840 and 1,156,710; in Italian Pat. No. 612,843; and in German Pat. No. 2,545,181.

However, in contrast to these various prior art centralizer designs, the present invention offers an improvement to the centralizer design disclosed in U.S. Pat. No. 4,011,907 issued to Clay on Mar. 15, 1977 and assigned to Halliburton Company, the assignee of the present invention. Generally, all the above mentioned centralizer designs which occupy a small volume of space during shipping and are subsequently assembled after shipping to the desired destination, except for U.S. Pat. No. 4,011,907, have a member on the centralizer end collars which engages a bent portion of the spring end. This generally requires that the spring end be bent through at least one and possibly several ninety degree (90°) bends to form the bent portion. The centralizers described in U.S. Pat. No. 4,077,470 and U. K. Pat. No. 1,156,710 also disclose the use of members to be deformed into engagement with the springs once the springs are assembled to the end collars. However, neither of the patents using members deformed into engagement with the end collars have a simple geometrically shaped spring end or deformable member.

In contrast to the prior art centralizer designs, the present invention improves upon the centralizer design disclosed in U.S. Pat. No. 4,011,907 by including a deformable tab means on each lip of the end collars which can be deformed into engagement with a surface of a recess in each end of each spring thereby providing a means of preventing each spring from disengaging the end collars when the centralizer is subjected to compressional loading.

The apparatus of this invention is more fully described in the accompanying drawings which include:

FIG. 1, a side view of a centralizer in position in a wellbore.

Figure 2:
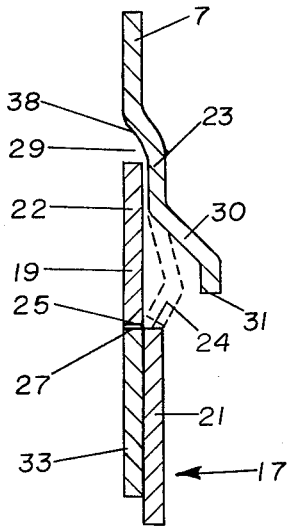

FIG. 2, a radial cross-section along lines 2—2 of FIG. 1 of a portion of an end collar and spring end showing the attachment thereof.

Figure 3:
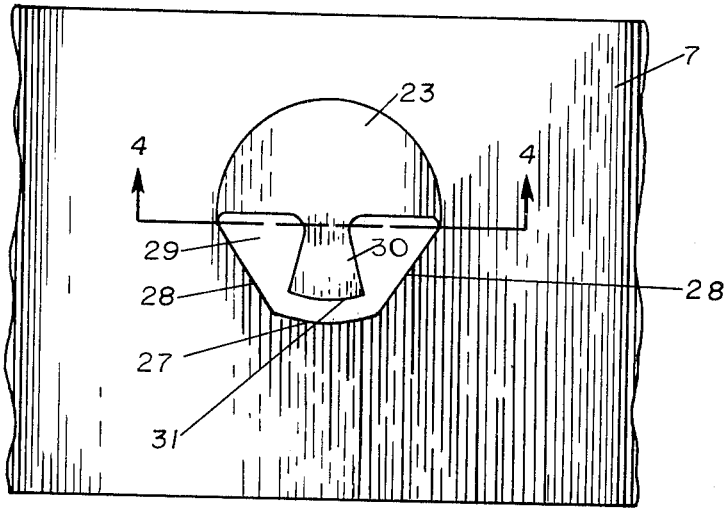

FIG. 3, an exterior view of a portion of the end collar showing the lip and deformable tab thereon.

Figure 4:
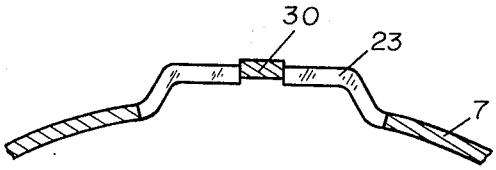

FIG. 4, a view taken along lines 4—4 of FIG. 3 showing the lip and deformable tab thereon of the end collar in cross-section.

Figure 5:
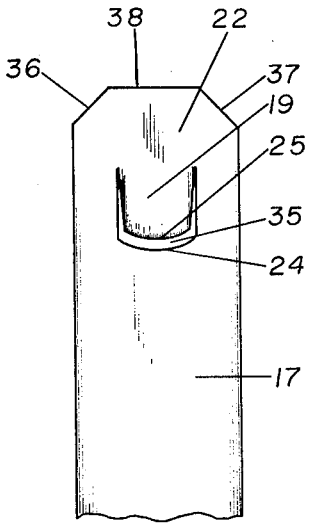

FIG. 5, a view of the end portion of a spring showing the recess therein.

Referring to FIG. 1, the preferred embodiment of the present invention is shown. A centralizer 1 is attached to a casing, drill pipe or other tubular member 3 disposed within a wellbore 5. The centralizer 1 includes end collars 7 and 9 and a plurality of outwardly bowed springs 11. The end collars 7 and 9 can be split to facilitate attachment to tubular member 3 and can be provided with hinges 13 to connect the split portions thereof. A limiting device 15, such as the EZ LOK*tm* limit clamp described on page 3159 of Halliburton Services Sales and Service Catalog Number 39, can be positioned on tubular member 3 and end collars 7 and 9 attached thereabove and therebelow, respectively. Alternatively, the end collars could be similarly attached above and below a coupling collar (not shown).

FIG. 1 and FIG. 2 show the connection of one end of a spring 11 to its respective end collar 7. The end portion 17 of spring 11 includes an inwardly projecting lug 19 and fulcrum portion 21. A projection 22 of lug 19 extends longitudinally so as to fit inside lip 23 of end collar 7 and form an outer radial ledge 24 between fulcrum portion 21 and lug 19. Lip 23 can be semi-circular as shown in FIG. 1 and FIG. 3, or various other shapes so long as lip 23 overlies lug 19 at some point to restrain lug 19 from moving radially outward. The inner longitudinal end surface 25 of lug 19 can be corresponding in shape to the inner longitudinal surface 27 of an opening 29 in which lug 19 fits. Lip 23 helps to hold lug 19 radially inward to maintain surfaces 25 and 27 into contact to prevent longitudinal movement of spring end portion 17 relative to its respective end collar 7.

Also formed on lip 23 is a deformable tab means 30 which is initially formed to project outwardly from lip 23 to allow assembly of the spring end portion 17 relative to its respective end collar 7. Once spring end portion 17 has been assembled to its respective end collar 7, the deformable tab means 30 is deformed into engagement with end surface 31 abutting outer radial ledge 24 of the spring end portion 17 (shown in broken lines in FIG. 2). In this manner, lip 23 also maintains surfaces 31 and 24 in contact to prevent longitudinal movement of spring end portion 17 relative to its respective end collar 7 as well as maintaining surfaces 25 and 27 in contact.

Fulcrum portion 21 overlies the inner longitudinal portion 33 of end collar 7 to assure that any inward radial movement of center portion 12 of spring 11 will tend to cause outward radial force on lug 19 to cause projection 22 forcibly to abut lip 23. Surfaces 25 and 27 are preferably made arcuate to facilitate assembly of centralizer 1 or to allow the spring 11 to assume a helical shape (not shown) in response to torsional loads applied to centralizer 1.

Referring to FIG. 3, the preferred embodiment of opening 29, lip 23 and surface 27 is shown. Lip 23 is a semi-circle covering approximately the outer longitudinal half of opening 29 while deformable tab means 30 covers a portion of the remainder of opening 29. The sides 28 of the remaining portion of opening 29 can be straight or any convenient shape while surface 27 is preferably circular in shape. It can also be seen that end surface 31 of deformable tab means 30 is preferably formed in a circular shape, although it could be flat if desired.

Referring to FIG. 4, it can be easily seen that lip 23 is deformed outwardly from end collar 7 to accommodate the upper end of end portion 17 of spring 11.

Referring to FIG. 5, the end portion 17 of spring 11 is shown. As shown, lug 19 is deformed inwardly from the end portion 17 thereby creating recess 35 into which deformable tab means 30 is received when the springs 11 are assembled to end collars 7 and 9. As shown, the surface 25 of lug 19 and surface 24 are preferably circular in shape to mate with circular surface 27 of end collar 7 and 31 of deformable tab means 30.

As shown, the lug 19 is formed having an arcuate free end portion having surface 25 thereon while the other end of the lug 19 is integrally attached to the end of the spring band. The projection 22 of the lug 19 can be easily seen having chamfered surfaces 36 and 37 thereon while surface 38 is generally straight. While projection 22 of the lug 19 can be shaped to have any convenient configuration, such as semi-circular, etc.

Assembly can be done manually using simple tools, such as pipe wrenches, a vise and a hammer.

Lip 23 can be formed by forging or otherwise radially and outwardly bending a portion of end collar 7 so as to make an overlying lip for a portion of lug 19 and the end of end portion 17 of spring 11. Lug 19 could be formed on the springs 11 by simple forging, or otherwise forming the end portion thereof to produce the desired lug shape.

From the foregoing discussion it should be readily apparent that the present invention offers the improvement over the centralizer described in U.S. Pat. No. 4,011,907 by providing a deformable tab means 30 on the lip 23 as an engagement means for the end of spring 11. When the deformable tab means 30 engages surface 24, any compressional loading of the centralizer 1 will cause the surface 31 of deformable tab means 30 to abut surface 24 thereby preventing the end portion 17 of spring 11 from disengaging end collar 7. Without having a deformable tab means engaging a surface of a recess in the end portion 17 of a spring, such as the design illustrated in U.S. Pat. No. 4,011,907, the end portion 17 of the spring 11 merely is forced to disengage the end collar 7 by a compressional force applied to the centralizer 1.

It should be noted that while the present invention has been described with respect to end collar 7, end collar 9 has the same configuration as end collar 7 and the end portions 17 of the springs 11 are assembled into relationship with end collar 9 in the same manner as end collar 7.

From the description of the invention set forth herein, it will be readily apparent to those skilled in the art to make minor variations within the scope of the invention.

Having thus described my invention, I claim:

1. In a knockdown centralizer of the type having at least two separate end collars with a plurality of openings therein for receiving a plurality of spring bands in non-welded interlocking fulcrumed engagement with said end collars, said spring bands having inwardly projecting lug means attached to opposite end portions for providing arcuate inner longitudinal interlock surfaces, said end collars having arcuate inner longitudinal surfaces defining opening means for receiving and longitudinally restraining said lug means while allowing rotation between said lug means and said opening means and having an overlying means for partially radially overlying said opening means and radially inwardly restraining said lug means which said opening means, wherein the improvement comprises:

said spring bands having a recess formed in each end therein by inwardly displacing said lug means from a portion of said spring band to form an integrally attached lug means having an integrally attached end and an arcuate shaped free end thereby creating an abutment surface in said spring band and an abutment surface on the free end of said lug means whereby said arcuate shaped free end abuts an arcuate inner longitudinal surface of said opening means in said end collar when said spring band is assembled thereto; and deformable tab means formed on each said overlying means for partially radially overlying said opening means, said deformable tab means formed having an end surface for abutting said abutment surface of said recess in said spring band when said spring band is assembled to said end collar and said deformable tab means is deformed into said recess in each end of said spring band whereby longitudinal movement of said spring band with respect to said end collar in a first direction is prevented by said arcuate shaped free end of said lug means abutting a surface of said opening means in said end collar and longitudinal movement of said spring band with respect to said end collar in a second direction is prevented by said end surface of said deformable tab means abutting said abutment surface of said recess in said spring band thereby preventing longitudinal movement of said spring band with respect to said end collar.

* * * * *

UNITED STATES PATENT AND TRADEMARK OFFICE

CERTIFICATE OF CORRECTION

PATENT NO. : 4,269,269

DATED : May 26, 1981

INVENTOR(S) : Donald R. Wilson

It is certified that error appears in the above-identified patent and that said Letters Patent are hereby corrected as shown below:

In column 4, line 25, delete "which" and insert therefor --with--.

Signed and Sealed this

*Twenty-second* Day of *September 1981*

[SEAL]

*Attest:*

GERALD J. MOSSINGHOFF

*Attesting Officer*

*Commissioner of Patents and Trademarks*